US005393446A

United States Patent [19]

Matsumoto

[11] Patent Number: 5,393,446

[45] Date of Patent: Feb. 28, 1995

[54] PROCESS FOR PREPARING DETERGENT COMPOSITION CONTAINING SODIUM AND POTASSIUM OXIDES

[75] Inventor: Hidezo Matsumoto, Tokyo, Japan

[73] Assignee: ECO Japan Co., Ltd., Tokyo, Japan

[21] Appl. No.: 167,370

[22] Filed: Dec. 16, 1993

[30] Foreign Application Priority Data

Dec. 16, 1992 [JP] Japan ..... 4-354540
Oct. 27, 1993 [JP] Japan ..... 5-291445

[51] Int. Cl.[6] ..... C11D 17/00; C11D 7/04

[52] U.S. Cl. ..... 252/90; 252/89.1; 252/156; 252/160

[58] Field of Search ..... 252/90, 89.1, 175, 176, 252/179, 174.25, DIG. 15, 156, 160, 135

[56] References Cited

U.S. PATENT DOCUMENTS 3,954,672 5/1976 Somers et al. ..... 252/455 R
4,051,056 9/1977 Hartman ..... 252/99
4,944,165 7/1990 Leebeek et al. ..... 68/17 R
5,028,569 7/1991 Cihon ..... 501/32

*Primary Examiner*—Christine Skane
*Assistant Examiner*—Lorna M. Douyon
*Attorney, Agent, or Firm*—Lowe, Price, LeBlanc & Becker

[57] ABSTRACT

A detergent composition comprises a fired ceramic body, which carries as effective ingredients sodium oxide and potassium oxide thereon. Sodium metaphosphate and/or calcium oxide may also be carried as optional ingredient(s). The fired ceramic body may be made of a ceramic material formed primarily of silicon oxide and aluminum oxide. Preferably, the detergent composition may be in the form of granules and may be enclosed in a container defining apertures through a wall thereof. These apertures are dimensioned so that the granular detergent composition are prevented from being lost therethrough. A granular detergent composition can be produced, for example, by adding sodium oxide and potassium oxide to a ceramic material, adding water to the resulting dry ceramic powder, kneading and forming the resulting mixture into a green body of a predetermined shape, drying the green body, firing the thus-dried green body at 500° C. to 700° C., impregnating the resulting fired body with an aqueous solution of sodium metaphosphate, and firing the thus-impregnated body again at a temperature in a range of from 200° C. to 400° C.

2 Claims, 2 Drawing Sheets

PROCESS FOR PREPARING DETERGENT COMPOSITION CONTAINING SODIUM AND POTASSIUM OXIDES

BACKGROUND OF THE INVENTION

1. Field of the Invention

This invention relates to a detergent composition useful for washing clothing or a like purpose and also to its production process. More specifically, this invention is concerned with a detergent composition, which permits gradual release into water or warm water of ingredients effective for cleaning and can hence retain an excellent cleaning action over a long time, and also with a production process of the same.

2. Description of the Related Art

To wash clothing or the like in a washing machine, a synthetic detergent such as sodium linear-alkylbenzenesulfonate (LAS), sodium alkylsulfate (SA) or sodium α-olefinsulfonate (AOS) or powder soap produced by adding soda ash as a builder to the sodium salt of a fatty acid as an effective ingredient is generally employed.

Synthetic detergents such as LAS mentioned above for washing clothing made of various materials such as chemical fibers, cotton and linen have excellent efficiency for the removal of stains, soil and/or dirt (hereinafter collectively called "stains") owing to the action of a surfactant contained therein.

Their biodegradability is however not good so that they cause liver problems or skin problems and enzymatic activity inhibition with the human body. When sewage flows into rivers or the like, water contamination and noxious effects to fish cannot be avoided. They hence involve problems to the environment.

Soap powder, on the other hand, has better biodegradability than synthetic detergents and can substantially reduce the problems of LAS and the like. Their detergency however drops to a significant extent unless they are used at high temperatures (40° C. and higher). Further, they are costly because the supply of oil or fat raw materials is not abundant.

In addition, the stain-removing action of soap powder is dependent on the surface activating action whereby molecules of oil are cut off to make the oil compatible with water and thus to release the oil into water. Soap powder therefore cannot fully overcome the problem of water contamination caused by sewage.

These synthetic detergents and soap powder are accompanied by the inherent cumbersome problem that, upon washing in washing machines, they have to be measured and added into tubs each time. It is also necessary to pay attention to the volume ratio of a detergent or soap powder to water.

They also involve the problem that clothing cannot be rinsed sufficiently when too much detergent or soap powder is added but cannot be washed sufficiently when too little is added.

SUMMARY OF THE INVENTION

An object of the present invention is to provide a detergent composition, which has excellent detergency, does not cause the problem of water contamination even when drained together with sewage to a sewage works and, moreover, can retain cleaning effects over a long period. Another object of the present invention is to provide a process for the production of the detergent composition.

In one aspect of the present invention, there is thus provided a detergent composition comprising a fired ceramic body which carries as effective ingredients sodium oxide and potassium oxide thereon.

In another aspect of the present invention, there is also provided a detergent composition comprising:

coarse granular or granular, fired ceramic bodies which are made of a ceramic material formed primarily of silicon oxide and aluminum oxide and carry thereon sodium oxide, potassium oxide and sodium metaphosphate as effective ingredients; and a container enclosing the fired ceramic bodies therein and having an outer wall through which apertures are formed, said apertures being dimensioned so that the fired ceramic bodies are prevented from being lost through the apertures.

In a further aspect of the present invention, there is also provided a process for the production of a detergent composition, comprising:

adding sodium oxide and potassium oxide to a ceramic material formed primarily of silicon oxide and aluminum oxide, whereby a dry ceramic powder is obtained;

adding water to the dry ceramic powder;

kneading and forming the resulting mixture into a predetermined shape, whereby a green body is obtained;

drying the green body;

firing the thus-dried green body at 500° C. to 700° C.;

impregnating the resulting fired body with an aqueous solution of sodium metaphosphate; and firing the thus-impregnated body again at a temperature in a range of from 200° C. to 400° C.

In a still further aspect of the present invention, there is also provided a process for the production of a detergent composition, comprising:

adding sodium oxide and potassium oxide to a ceramic material formed primarily of silicon oxide and aluminum oxide, whereby a dry ceramic powder is obtained;

adding water to the dry ceramic powder;

kneading and forming the resulting mixture into green granules having a granule size in a range of from 3 mm to 10 mm;

drying the green granules;

firing the thus-dried green granules at 500° C. to 700° C.;

impregnating the resulting fired granules with a 3–8% aqueous solution of sodium metaphosphate; and firing the thus-impregnated granules at a temperature in a range of from 200° C. to 400° C.

The term "granules" as used herein should not be interpreted to have any particular small size or shape. The granules can be, for example, in the form of balls, beads, pellets, disks or the like. They can have a granule size, for example, in a range of from 3 mm to 10 mm.

Since the detergent composition according to the present invention contains sodium oxide and potassium oxide carried as effective ingredients on the fired ceramic body, the effective ingredients are gradually released into water when the fired ceramic body is brought into contact with water or the like. The effective ingredients hence can activate water or the like and, at the same time, can remove a stain deposited on clothing or the like.

In particular, the detergent composition according to the present invention exhibits superb functions such as cleaning of clothing and purification of water or warm water without contamination of water under the action of milder alkali substances based on metal ions different from conventional surfactants.

The detergent composition is also excellent in that it can continuously show its effects such as cleaning effects over a long period because it is basically formed of ceramics.

The production processes according to the present invention can economically provide detergent compositions which are free of the problem of water contamination.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
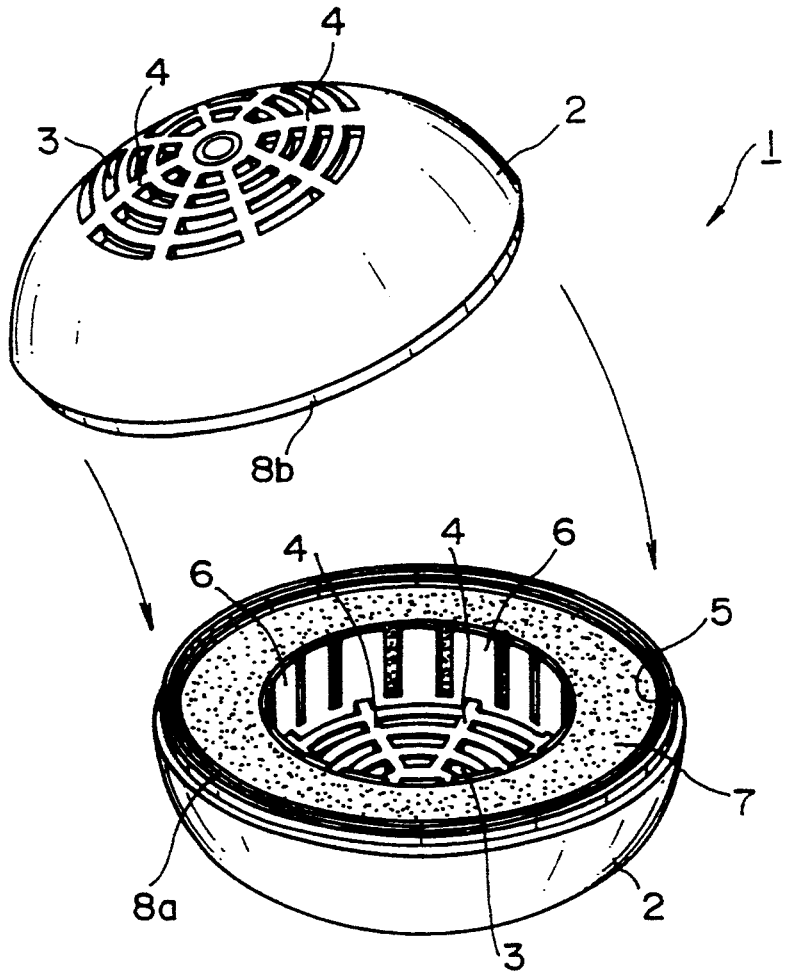
FIG. 1 is an exploded perspective view of an illustrative container useful upon application of a detergent composition of this invention.

From the standpoint of cleaning effects, it is preferred to incorporate, as effective ingredients of the detergent composition, sodium oxide and potassium oxide individually in an amount ranging from 6 wt. % to 15 wt. % based on the whole amount of the composition including a ceramic material (accordingly, the total amount of both the effective ingredients being from 12 wt. % to 30 wt. %) in such a way that they are contained in substantially the same amount or potassium oxide is contained in an amount slightly greater than sodium oxide.

If the total amount of ($Na_2O+K_2O$) is too small relative to the ceramic material, desired cleaning effects cannot be expected. It however becomes difficult to fire the ceramic material if the effective ingredients are contained to too large an extent.

As the ceramic material on which the effective ingredients are carried, use of clay formed principally of silicon oxide ($SiO_2$) and aluminum oxide ($Al_2O_3$) is preferred. The weight ratio of $SiO_2$ to $Al_2O_3$ can desirably range from about 95/5 to 75/25.

If the ceramic material contains as an impurity an iron compound such as ferric oxide ($Fe_2O_3$) at a high concentration, there is the potential problem that an item to be washed, such as clothing, may be colored due to leaching of the iron compound. It is therefore desired to use a ceramic material containing $Fe_2O_3$ in an amount not greater than 1 wt. % based on the total weight and preferably as low as possible.

$Na_2O$ and $K_2O$ as the effective ingredients are mixed in the ceramic material and, subsequent to addition of water, thoroughly kneaded together with the ceramic material. The resulting mixture is formed in a shape predetermined in accordance with the application. The green body so formed is then fired.

When used for cleaning clothing, for example, the detergent composition can be used by forming it into granules having a granule size in a range of from 3 mm to 10 mm. As an alternative, the fired ceramic body of the detergent composition according to the present invention can also be formed to have the configurations of an agitator in a washing machine. Use of this agitator also permits washing of clothing.

The ceramic material with $Na_2O$ and $K_2O$ mixed as effective ingredients therein is, subsequent to its kneading, formed into a predetermined shape and is then dried to an appropriate extent by natural drying or the like. The green body so dried is thereafter fired at 500° C. to 700° C., preferably 600° C. to 650° C. for 1 to 5 hours, preferably 3 to 4 hours.

The ceramic body so fired is next immersed for approximately 1 to 3 hours, preferably about 2 hours in an aqueous solution of sodium metaphosphate ($NaPO_3$), the concentration of said aqueous solution being 3 to 8%, preferably about 5%, whereby the fired body is impregnated with sodium metaphosphate.

The fired body so impregnated is then fired at a temperature not higher than 400° C., preferably from 200° C. to 400° C. for approximately 2 to 5 hours, preferably 3 to 4 hours, so that a detergent composition is obtained. The detergent composition so obtained is an unglazed porous ceramic body containing as effective ingredients $Na_2O$, $K_2O$, $NaPO_3$ and the like.

The detergent composition according to the present invention may contain calcium oxide (CaO) as an additional effective ingredient.

In this case, it is preferred to individually add sodium oxide, potassium oxide and calcium oxide, which are effective ingredients of the detergent composition, in an amount of from 6 wt. % to 10 wt. % based on the whole amount of the composition including the ceramic material (accordingly, the total amount of all the three effective ingredients accounting for 18 wt. % to 30 wt. %).

If the amount of ($Na_2O+K_2O+CaO$) is too small relative to the ceramic material, desired cleaning effects cannot be expected. It however becomes difficult to fire the ceramic material if too much of the effective ingredients are contained.

To wash clothing, the detergent composition according to the present invention can be produced by forming the fired ceramic body in the form of granules and enclosing about 25 g of the granules (200 to 240 granules where they have a granule size of about 3 mm) within a container having an outer wall through which apertures are formed, said apertures being dimensioned so that the granules are prevented from being lost through the apertures. Depending on the amount of clothing to be washed and the extent of stains of the clothing, one or two of such containers are placed in the tub of a washing machine. When the washing machine is then operated, the effective ingredients contained in CaO, are brought into contact with water and are gradually released into the water, so that they remove stains of the clothing.

For heavily stained clothing, still better detergency can be obtained by using a synthetic detergent and/or a soap powder in combination in an amount (weight) not greater than one third of an ordinarily used amount per container.

The detergent composition contained in each container after the washing can be used in subsequent washing by taking the container out of the washing machine and allowing the detergent composition to dry naturally.

The container can be used repeatedly until the detergent composition contained in the container wears smaller as a result of its contact with water and is lost naturally through the apertures formed in the wall of the container. In ordinary domestic washing, the container can be used for about one year.

Further, the detergent composition according to the present invention can also be used for the purification of water or warm water by enclosing it in the above container or the like and placing it in the water or warm water.

By placing the container in a toilet tank, it is possible to activate water in the tank and hence to clean stains on a toilet bowl.

When the detergent composition is enclosed in a container or the like and is placed in a bath tub, the water in the bath tub can be purified so that the bath tube can be deslimed and deodorized.

The detergent composition according to the present invention appears to exhibit its detergency in accordance with the below-described mechanism.

In the detergent composition according to the present invention, effective ingredients capable of forming metal ions upon contact with water—such as $Na_2O$ and $K_2O$ and optionally sodium metaphosphate—are carried on the fired ceramic body.

When the detergent composition is placed in water, the fired ceramic body is brought into contact with water so that metal ions in the effective ingredients, such as $Na^+$ and $K^+$, replace hydrogen ions ($H^+$) in the water to cause a so-called ion exchange action. As a result, hydrogen ions are introduced into the ceramic structure while sodium and potassium are present as $Na^+$ and $K^+$ in the water.

The water therefore contains $OH^-$ ions together with $Na^+$ and $K^+$ ions. These ions are considered to form an aqueous solution of lye (KOH) and caustic soda (NaOH) and to directly disintegrate stains of clothing.

The sodium and potassium appear to be gradually released from the surface of the fired ceramic body through an ion exchange and to be gently ionized into $Na^+$ and $K^+$ ions in the water. As a consequence, the water can remove stains of clothing without forming any highly alkaline state. Here, the impregnated sodium metaphosphate seems to enhance the detergency.

The above action is not limited to the above-described washing but can also exhibit superb utility for the purification of water through a pH change.

The present invention will hereinafter be described in further detail by the following Examples. It is however to be borne in mind that the present invention is not limited to or by them.

Figure 2:
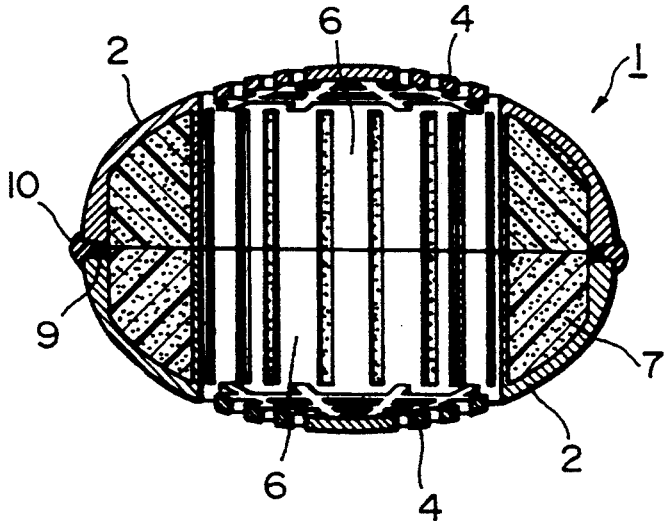
FIG. 2 is a vertical cross-sectional view of the container in a closed state.

Illustrative Container for Enclosing Detergent Composition of the Present Invention As illustrated in FIG. 1 and FIG. 2, a container 1 is constructed of two dome-shaped split halves 2,2. These split haves are produced from a synthetic resin by injection molding and, when put together, form the container which is about 70 mm in diameter and about 50 mm in height and has a circular shape in a plan view and an oval shape in a cross-sectional view.

Each split half 2 defines a predetermined number of apertures 3,3, . . . that is, circular slits formed concentrically through an outer wall thereof. Circular wall portions remaining between the adjacent apertures are supported by plural ribs 4,4, . . . which extend radially from a center of a top face.

Formed at and along peripheral edges of openings of the split halves 2,2 are mating portions **8*a*,8*b*, which have complementary concave and convex configurations, respectively, and can be fitted together. As a result of this fitting, an annular slot 9** is formed in an outer periphery.

Plural support pieces 6,6, . . . are formed on each split half 2 with an interval of about 10 mm being maintained toward a center from an inner peripheral wall 5. Disposed between the inner peripheral wall 5 and the support pieces 6 is an expanded polystyrene foam 7 which contains closed cells to impart buoyancy to the container.

The above-described granular detergent composition (not shown) is placed within a cylindrical recess inside the support pieces 6,6, . . . When the split halves 2,2 are put together, the detergent composition is enclosed inside the container 1 while allowing water to flow in and out through the apertures 3,3, . . .

The mating portions **8*a*,8*b* are fixed together with an adhesive or by fusion bonding, so that the container 1** is closed to enclose the detergent composition therein.

Designated at numeral 10 in FIG. 2 is a ring-shaped ornamental member made of a metal and maintained in engagement with the slot 9.

Although not illustrated in the drawings, the mating portions of the split halves 2,2 can be externally covered by an elastomeric material such as a urethane resin. The elastomeric material can reduce impacts of the container to the tub of the washing machine during agitation.

Production of Detergent Composition

Example 1

Employed as a ceramic material was a clay containing 63.0 parts (parts by weight; all designations of "part" or "parts" will hereinafter have the same meaning) of silicon oxide ($SiO_2$) and 11.6 parts of aluminum oxide ($Al_2O_3$) and, as impurities, small amounts of ferric oxide ($Fe_2O_3$), titanium oxide ($TiO_2$), calcium oxide (CaO) and magnesium oxide (MgO).

The clay was mixed with 10.0 parts of sodium oxide ($Na_2O$) and 12.0 parts of potassium oxide ($K_2O$) as effective ingredients of a detergent composition. The dry ceramic powder so obtained was added with water and then kneaded. The resulting mixture was subjected to granulation, whereby coarse granules having a diameter of about 6 mm were obtained.

The coarse granules were left over for about 30 minutes in the air and allowed to dry naturally. The granules were then fired at 650° C. for about 4 hours in a firing furnace.

The fired body so obtained was taken out from the firing furnace and allowed to cool down gradually to room temperature. The fired body was then immersed for about 2 hours in a 5% aqueous solution of sodium metaphosphate ($NaPO_3$) so that the fired body was impregnated with sodium metaphosphate.

The fired body so impregnated was then placed again in the same firing furnace and fired at about 350° C. for approximately 3 hours, whereby the detergent composition according to the present invention was obtained in the form of coarse granules.

Washing of Clothing by Detergent Composition

Examples 1–4 and Comparative Examples 1–4

One hundred granules (about 25 g) of the coarse granular detergent composition obtained in Example 1 were enclosed within the synthetic resin container 1 shown in FIGS. 1 and 2. Two of such containers were added to the tub of a washing machine.

Stained cotton fabric sheets were prepared by separately soaking cotton fabric sheets of 1 $m^2$ to an equal extent with various staining substances while using four of the cotton fabric sheets per staining substance. Those stained fabric sheets were separately placed in the washing machine to conduct washing with the detergent composition, whereby washed fabric sheets of Examples 1–4 were obtained. In addition, similar stained fabric sheets were also washed with a synthetic detergent under similar conditions so that washed fabric sheets of Comparative Examples 1–4 were obtained. The washing results of those washed fabric sheets are presented in Table 1.

TABLE 1

| | No. | Staining substance | Results |
|---|---|---|---|
| Ex. | 1 | Barbecue sauce | Snow white |
| | 2 | Gravy, soy sauce, soup stock, sake, sweet sake | Snow white |
| | 3 | Worcester sauce, ketchup, mayonnaise | Snow white |
| | 4 | Sludge | Practically snow white |
| Comp. Ex | 1 | Barbecue sauce | Snow white |
| | 2 | Gravy, soy sauce, soup stock, sake, sweet sake | Snow white |
| | 3 | Worcester sauce, ketchup, mayonnaise | Snow white |
| | 4 | Sludge | Staining substance remained |

Example 5

About 30/ of tap water were poured into the washing machine and two synthetic resin containers, each containing about 25 g of a detergent composition of the present invention produced in a similar manner to Example 1, were placed in the tub of the washing machine. The water was agitated and the pH of the water in the tub was measured at intervals of 5 minutes for 20 minutes.

The two containers were then taken out of the washing machine and allowed to dry naturally. Using the containers, the same operation was repeated in fresh tap water on the following day so that the pH was measured at intervals of 5 minutes for 20 minutes.

The above operation was repeated five times in total (for 5 days) to investigate pH variations. Those pH values were compared with the pH value of the tap water before the test. The results are summarized in Table 2.

Incidentally, the following washing machine and pH meter were used and the tap water had the following temperature:

Washing machine: "AOZORA KW-32LX", trade name; manufactured by Hitachi, Ltd. Agitation was conducted by the standard water current.

pH meter: "Personal pH Meter", trade name; manufactured by Yokogawa Electric Corp.

Tap water temperature: 21° C. to 22° C.

TABLE 2

| | Results (pH value) | | | | |
|---|---|---|---|---|---|
| Test | Before test | 5 min. later | 10 min. later | 15 min. later | 20 min. later |
| 1st | 7.1 | 7.6 | 7.9 | 8.2 | 8.6 |
| 2nd | 6.7 | 7.6 | 8.9 | 9.1 | 9.1 |
| 3rd | 6.9 | 7.7 | 8.8 | 9.0 | 9.0 |
| 4th | 6.8 | 7.2 | 8.0 | 8.9 | 9.0 |
| 5th | 6.8 | 7.1 | 7.6 | 8.1 | 8.5 |

From the results shown in Table 2, the pH of the tap water before the test ranges from 6.7 to 7.1 and remained substantially neutral. With the passage of the agitation time, the pH however arose to 8.5 to 9.1, that is, to the alkaline side.

It is considered that the alkali ingredients were leached from the detergent composition through an ion exchange and contributed to the cleaning and also that the long-lasting property of detergency was retained because substantially the same pH value was shown throughout the repeated, first to fifth tests.

In particular, the long-lasting property is believed to be retained surely by drying the detergent composition as needed between applications.

Quality Test of Washing

The washing machine with 30/ of tap water poured in the tub thereof was used. Two containers enclosing a detergent composition produced in a similar manner to Example 1 (each of said containers containing about 25 g of the coarse granular detergent composition) were placed in the tub and the water was then agitated. The washing was measured for COD (mg//) and BOD (mgO//) (Example 6).

The above operation was repeated likewise by using 25 g of a synthetic detergent (Comparative Example 5) and 40 g of a soap powder (Comparative Example 6) in place of the above detergent composition. Each washing so obtained was also measured for COD (mg//) and BOD (mgO//). The results are summarized in Table 3.

TABLE 3

| | COD (mg/l) | BOD (mgO/l) |
|---|---|---|
| Example 6 | <5 | <5 |
| Comp. Ex. 5 | 95 | 330 |
| Comp. Ex. 6 | 230 | 920 |

The COD and BOD measurements of the washings were conducted following the industrial effluent testing method prescribed under JIS K-0102.

From the results shown in FIG. 3, it is understood that the COD and BOD of the washing obtained by using the detergent composition according to this invention are far lower compared with washings obtained by using the synthetic detergent or the soap powder.

Combined Use with Synthetic Detergent

Example 7 and Comparative Example 7

As Example 7, two synthetic resin containers, each enclosing 25 g of a detergent composition according to this invention produced in a similar manner to Example 1 were placed in the tub of the domestic washing machine (with 30/ of tap water) and the water was agitated for 10 minutes.

A commercial detergent concentrate "Zabu (trademark of a synthetic detergent manufactured and sold by Kao Soap Co., Ltd.) was then added in an amount (8.5 g/30/-water) about one third of the usual usage amount (25 g/30/-water). By a combined use with the two containers containing the detergent composition, stained clothing was washed. The washing time was set for 10 minutes and the rinsing time was set for 3 minutes.

As Comparative Example 7, on the other hand, washing was conducted under similar conditions while using only the commercial washing concentrate in an mount of 25 g per 30/ of water.

With respect to these washing tests, the detergencies were compared following the detergency evaluating method for laundry synthetic detergents (JIS k3371). As a result, the detergencies were found to be substantially the same.

Production Of Detergent Composition.

Example 8

Employed as a ceramic material was a clay containing 61.0 parts of silicon oxide ($SiO_2$) and 9.6 parts of aluminum oxide ($Al_2O_3$) and, as impurities, small amounts of ferric oxide ($Fe_2O_3$), titanium oxide ($TiO_2$), calcium oxide (CaO) and magnesium oxide (MgO).

The clay was mixed with 8.2 parts of sodium ,oxide ($Na_2O$), 9.6 parts of potassium oxide ($K_2O$) and 8.7 parts (total amount including calcium oxide contained as an impurity in the clay) of calcium oxide (CaO) as effective ingredients of a detergent composition. The dry ceramic powder so obtained was added with water and then kneaded. The resulting mixture was subjected to granulation, whereby coarse granules having a diameter of about 6 mm were obtained.

The coarse granules were left over for about 30 minutes in the air and allowed to dry naturally. The granules were then fired at 650° C. for about 4 hours in a firing furnace.

The fired body so obtained was taken out from the firing furnace and allowed to cool down gradually to room temperature. The fired body was then immersed for about 2 hours in a 5% aqueous solution of sodium metaphosphate ($NaPO_3$) so that the fired body was impregnated with sodium metaphosphate.

The fired body with $NaPO_3$ carried thereon was then placed again in the same firing furnace and fired at about 350° C. for approximately 3 hours, whereby the detergent composition according to the present invention was obtained in the form of coarse granules.

Use of Detergent Composition

Examples 8–11 and Comparative Examples 8–11

Twenty-five grams of the coarse granular detergent composition obtained in Example 8 were enclosed within the synthetic resin container 1 shown in FIGS. 1 and 2. Two of such containers were added to the tub of the washing machine.

Stained cotton fabric sheets were prepared by separately soaking cotton fabric sheets of 1 $m^2$ to an equal extent with various staining substances while using four of the cotton fabric sheets per staining substance. Those stained fabric sheets were separately placed in the washing machine to conduct washing with the detergent composition, whereby washed fabric sheets of Examples 8–11 were obtained.

In addition, similar stained fabric sheets were also washed with a synthetic detergent under similar conditions so that washed fabric sheets of Comparative Examples 8–11 were obtained. The washing results of those washed fabric sheets are presented in Table 4.

TABLE 4

| | No. | Staining substance | Results |
|---|---|---|---|
| Ex. | 8 | Barbecue sauce | Snow white |
| | 9 | Gravy, soy sauce, soup stock, sake, sweet sake | Snow white |
| | 10 | Worcester sauce, ketchup, mayonnaise | Snow white |
| | 11 | Sludge | Practically snow white |
| Comp. Ex | 8 | Barbecue sauce | Snow white |
| | 9 | Gravy, soy sauce, soup stock, sake, sweet sake | Snow white |
| | 10 | Worcester sauce, ketchup, mayonnaise | Snow white |
| | 11 | Sludge | Staining substance remained |

Use of Detergent Composition

Example 12 and Comparative Example 12

As Example 12, two samples were provided, each containing tap water in a beaker having a capacity of 1,000 m/. Each sample was added with about 6 g of the coarse granular detergent composition obtained in Example 8. While agitating the contents by a stirrer, the pH of the tap water was measured at varied water temperatures and stirring times.

As Comparative Example 12, two blank samples were provided, each containing only tap water in a beaker of the Same capacity. The pH was measured under three conditions, one after having been stirred for 5 minutes at 15° C., the remaining two after having been maintained at 15° C. and 30° C., respectively, without stirring.

The results are presented in Table 5, in which each asterisk indicates the pH value of the tap water before stirring.

The pH measurements were all conducted using a pH meter manufactured by Horiba Ltd. ("H-7P", trade name; accuracy: ±0.05).

TABLE 5

| | Temperature (°C.) | Agitation time (min.) | pH value |
|---|---|---|---|
| Ex. 12 | 15 | 5 | 8.21 |
| | 15 | 10 | 8.83 |
| | 15 | 15 | 9.65 |
| | 30 | 5 | 8.43 |
| | 30 | 10 | 9.10 |
| | 30 | 15 | 10.24 |
| Comp. Ex. 12 | 15 | 5 | 7.20 |
| | 15 | 0 | 7.20* |
| | 30 | 0 | 7.20* |

I claim:

1. A process for the production of a detergent composition, comprising:

adding effective detergent amounts of sodium oxide and potassium oxide to a ceramic material formed primarily of silicon oxide and aluminum oxide, whereby a dry ceramic powder is obtained;

adding water to the dry ceramic powder;

kneading and forming the resulting mixture into a predetermined shape, whereby a green body is obtained;

drying the green body;

firing the thus-dried green body at 500° C. to 700° C.;

impregnating the resulting fired body with an effective detergent amount of an aqueous solution of sodium metaphosphate; and firing the thus-impregnated body again at a temperature in a range of from 200° C. to 400° C.

2. A process for the production of a detergent composition, comprising:

adding effective detergent amounts of sodium oxide and potassium oxide to a ceramic material formed primarily of silicon oxide and aluminum oxide, whereby a dry ceramic powder is obtained;

adding water to the dry ceramic powder;

kneading and forming the resulting mixture into green granules having a granule size in a range of from 3 mm to 10 mm;

drying the green granules;

firing the thus-dried green granules at 500° C. to 700° C.;

impregnating the resulting fired granules with an effective detergent amount of a 3–8% aqueous solution of sodium metaphosphate; and firing the thus-impregnated granules at a temperature in a range of from 200° C. to 400° C.

* * * * *